US005928027A

United States Patent [19]

Kunishi

[11] Patent Number: 5,928,027

[45] Date of Patent: Jul. 27, 1999

[54] ELECTRICAL CONNECTOR SYSTEM FOR A FLAT FLEXIBLE CIRCUIT

[75] Inventor: Shinsuke Kunishi, Hadano, Japan

[73] Assignee: Molex Incorporated, Lisle, Ill.

[21] Appl. No.: 08/993,913

[22] Filed: Dec. 18, 1997

[30] Foreign Application Priority Data

Mar. 7, 1997 [JP] Japan ..... 9-070461

[51] Int. Cl.[6] ..... H01R 23/66

[52] U.S. Cl. ..... 439/495

[58] Field of Search ..... 439/495, 496, 439/67

[56] References Cited

U.S. PATENT DOCUMENTS 5,370,553 12/1994 Chishima et al. ..... 439/495

FOREIGN PATENT DOCUMENTS 4-11346 3/1992 Japan ..... H01R 9/07

7-153531 6/1995 Japan ..... H01R 23/68

7-282917 10/1995 Japan ..... H01R 23/68

7-335342 12/1995 Japan ..... H01R 23/68

8-180940 7/1996 Japan ..... H01R 23/68

*Primary Examiner*—Gary Paumen

*Assistant Examiner*—Briggitte Hammond

*Attorney, Agent, or Firm*—Stephen Z. Weiss

[57] ABSTRACT

An electrical connector system for terminating a flat flexible circuit. The circuit is elongated and of a given width and includes conductors extending longitudinally thereof. The circuit has a reinforcing plate defining a shoulder extending in the width direction of the circuit. An insulative housing has a plurality of terminals. An actuator is inserted into the housing for forcing the conductors of the flat flexible circuit into contact with the terminals. The actuator has an engaging portion extending in the width direction of the circuit for engaging the shoulder of the reinforcing plate and forcing the circuit into the housing.

4 Claims, 4 Drawing Sheets

ELECTRICAL CONNECTOR SYSTEM FOR A FLAT FLEXIBLE CIRCUIT

FIELD OF THE INVENTION

This invention generally relates to the art of electrical connectors and, particularly, to an electrical connector system for a flat flexible circuit, flat flexible electrical cable, flat printed circuit or the like.

BACKGROUND OF THE INVENTION

There are a wide variety of electrical connectors particularly adapted for terminating flat circuitry, such as flat flexible cables, flexible printed circuit boards and the like. These electrical connectors typically have a housing mounting a plurality of terminals in a generally parallel array spaced along an elongated opening or slot for receiving an end of the flat circuit.

When the circuit is terminated in the connector, the circuit must be held so that it cannot be withdrawn. Prior methods of holding the circuit include cutting holes or slots in the center of the circuit or cutting notches in the side of the circuit for engaging one or more holding projections on the connector housing. This system creates problems in that there are only a limited number of holding points and each holding point places a high stress on the circuit which may result in tearing the circuit. Another system is to frictionally grip the circuit. These systems create problems in that the forces required to adequately grip the circuit are so high that the connector housing must be reinforced to accommodate the forces, thereby unnecessarily increasing the size of the overall connector envelope.

Some connectors for flat flexible circuits use actuators to push the flexible circuits against resilient contact portions of the terminals. Again, such actuator systems often use restricted contact points or frictional gripping which causes excessive insertion forces.

The present invention is directed to solving these problems in an actuator-type connector for a flat flexible circuit wherein the engagement area between the actuator and the circuit is very large to prevent any tearing of the circuit, and the insertion forces required to insert the cable into the connector are minimal.

SUMMARY OF THE INVENTION

An object, therefore, of the invention is to provide a new and improved electrical connector system for a flat flexible circuit.

According to the system of the invention, an elongated flat flexible circuit has a given width and includes conductors extending longitudinally thereof. The circuit has a reinforcing plate defining a shoulder extending in the width direction of the circuit. An insulative housing has a plurality of terminals. An actuator is adapted to be inserted into the housing and forcing the conductors of the flat flexible circuit into contact with the terminals. The actuator has an engaging portion extending in the width direction of the circuit for engaging the shoulder thereof and forcing the circuit into the housing.

As disclosed herein, the conductors of the circuit are exposed on one side thereof and the reinforcing plate is disposed on the opposite side of the circuit. Each terminal includes a generally U-shaped end defining a biasing arm spaced from a contact arm such that the actuator is inserted into the space between the arms, with the contact arm engaging a conductor of the flat flexible circuit. The shoulder of the reinforcing plate and the engaging portion of the actuator extend across substantially the entire width of the flat flexible circuit.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
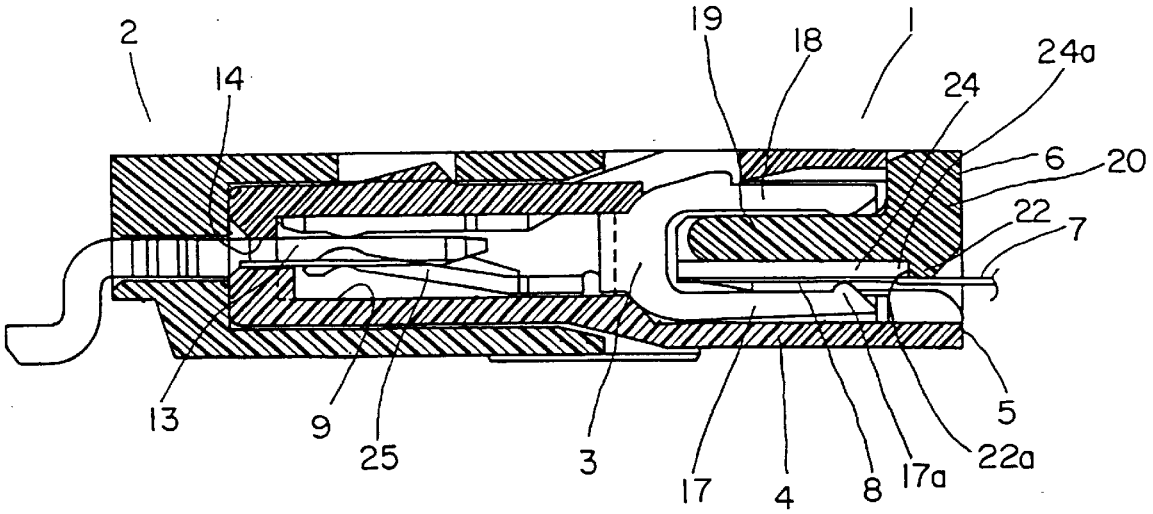
FIG. 1 is an axial section through an electrical connector for a flat flexible circuit according to the invention, connected to a mating connector and terminals, and showing the engaged or fully inserted position of the actuator.
Figure 2:
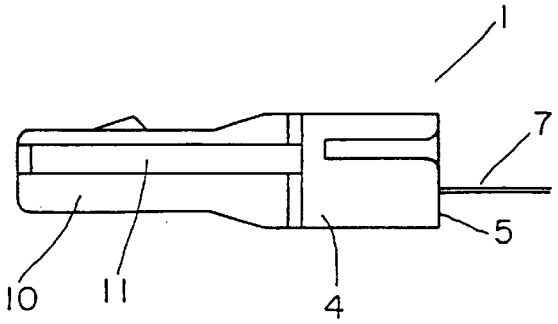
FIG. 2 is a side elevational view of the connector, with the mating connector removed.
Figure 3:
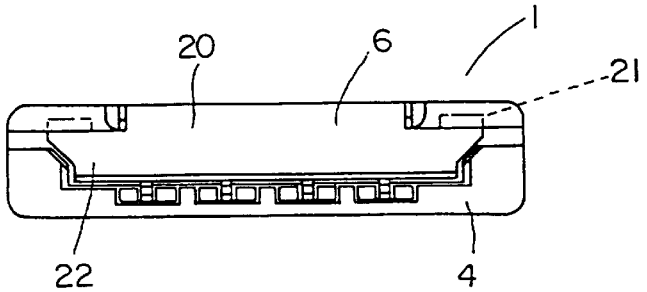
FIG. 3 is a rear elevational view of the connector.
Figure 4:
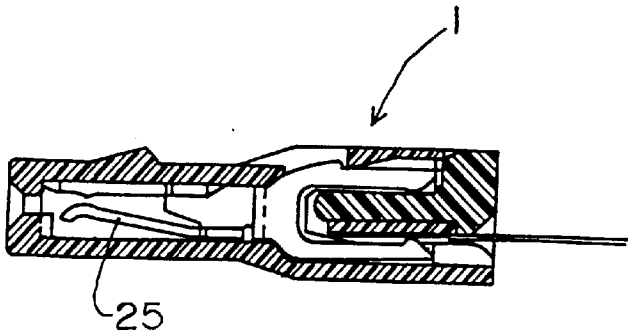
FIG. 4 is a sectional view of the connector similar to that of FIG. 1, on a reduced scale and with the mating connector removed.
Figure 5:
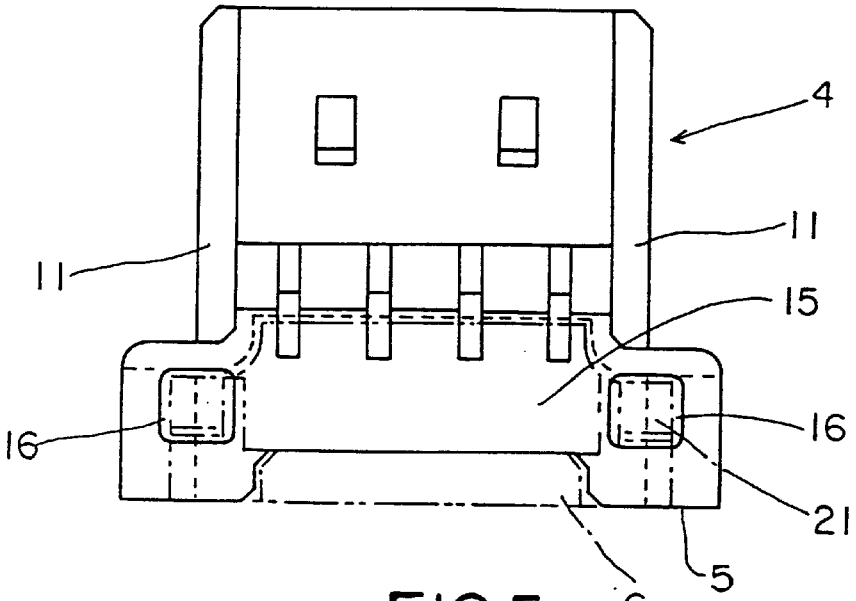
FIG. 5 is a top plan view of the connector.
Figure 6:
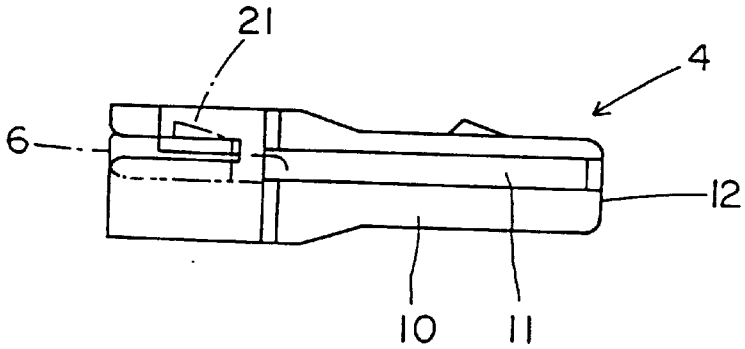
FIG. 6 is a side elevational view of the connector, opposite the side shown in FIG. 2.
Figure 7:
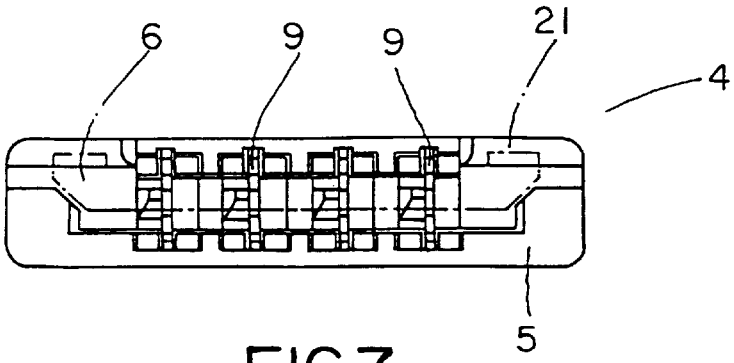
FIG. 7 is a front elevational view of the connector.
Figure 8:
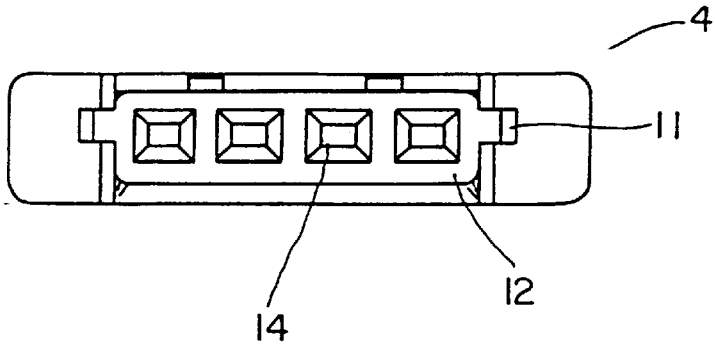
FIG. 8 is a rear elevational view of the connector housing, with the actuator removed.
Figure 12:
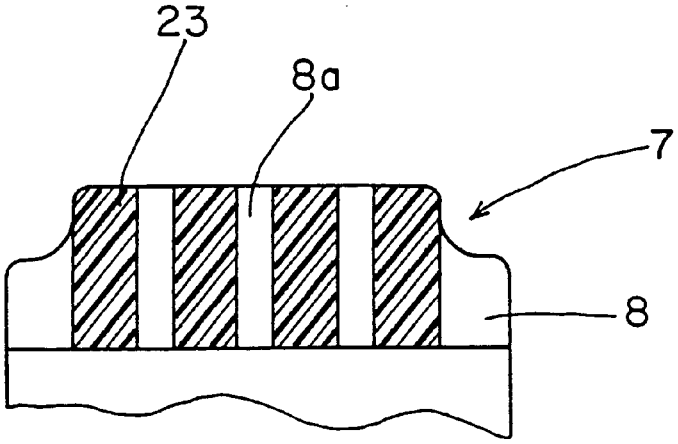
FIG. 12 is a plan view of the conductor side of the flat flexible circuit.
Figure 13:
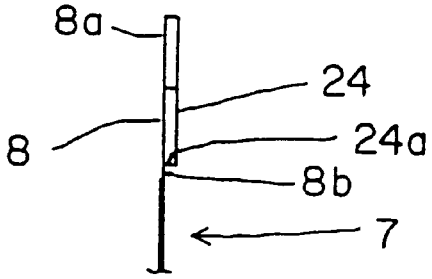
FIG. 13 is a side or edge elevational view of the circuit.

Referring to the drawings in greater detail, and first to FIG. 1, the invention is embodied in an electrical connector, generally designated 1, for terminating a flat flexible circuit which is shown in FIGS. 12 and 13. Connector 1 is adapted for mating with a complementary mating connector, generally designated 2. Connector 1 includes an insulative housing 4 mounting a plurality (four in the illustrated embodiment) of terminals 3 in a parallel array at a given spacing or pitch. An actuator 6 is adapted for insertion into and withdrawal from a rear end 5 of insulative housing 4. Generally, actuator 6 is used to insert a flat flexible cable 7 into the housing and in engagement with the terminals, with the terminals engaging conductors at a connecting end 8 of the circuit, as will be apparent hereinafter.

Referring to FIGS. 2–8 in conjunction with FIG. 1, insulative housing 4 is a one-piece structure unitarily molded of dielectric material such as plastic or the like. The rear end 5 of the housing is open and communicates with internal terminal-receiving passages 9. Flanges 11 projecting from the sides of the housing are adapted for moving into guide recesses (not shown) provided on the inside of mating connector 2. The flanges project outwardly from side walls 10 of the housing. Openings 14 (FIG. 8) in a front wall 12 of the housing are provided for receiving male terminal pins 13 (FIG. 1) from the mating connector. Rectangular openings 16 (FIG. 5) are provided in a top wall 15 of the insulative housing near rear end 5 thereof.

Each terminal 3 is stamped and formed from conductive sheet metal material. Each terminal includes a forwardly projecting spring arm 25 for engaging a respective one of the terminals 13 of mating connector 2 projecting through one of the openings 14 at the front of the insulative housing. The rear of each terminal is bifurcated or generally U-shaped to define a contact arm 17 which is spaced from a biasing arm 18. A plurality (four) of the terminals 3 are mounted in parallel relationship on a given pitch within terminal-receiving passages 9 through the open rear end 5 of insulative housing 4.

Figure 9:
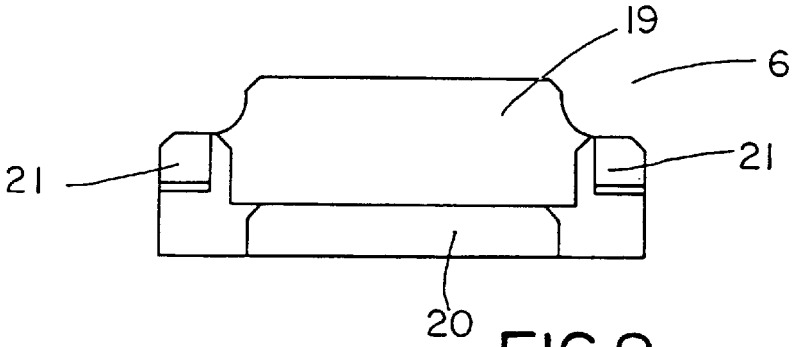
FIG. 9 is a top plan view of the actuator.
Figure 10:
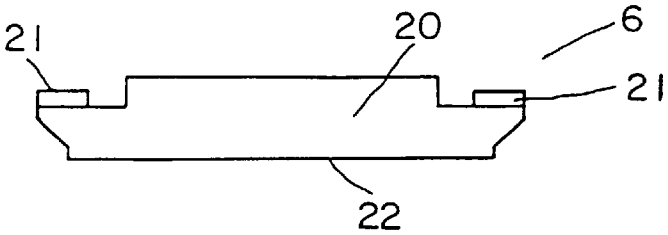
FIG. 10 is a rear elevational view of the actuator.
Figure 11:
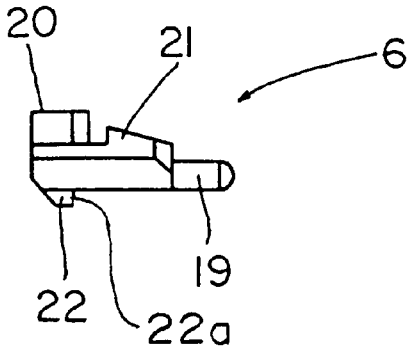
FIG. 11 is a side elevational view of the actuator.

Referring to FIGS. 9–11 in conjunction with FIGS. 1, 3–5, 7 and 8, actuator 6 is a one-piece structure unitarily molded of dielectric material such as plastic or the like. The actuator includes a wide retaining plate 19 adapted to be inserted into the space between contact arms 17 and biasing arms 18 of terminals 3, from the open rear end 5 of insulative housing 4. An operating portion 20 is provided at the rear of the actuator projecting upwardly from retaining plate 19. Ramped locking projections 21 are provided at each opposite side of the actuator, projecting upwardly therefrom and being adapted for engaging within openings 16 (FIGS. 5 and 6) in the top of insulative housing 4 to lock the actuator in its fully inserted position within the housing. Lastly, a wide engaging portion 22 defines an engaging shoulder 22*a* at the bottom rear edge of the actuator as seen best in FIG. 1. Engaging portion 22 extends substantially entirely across the actuator in the width direction thereof, as best seen in FIG. 10.

Referring to FIGS. 12 and 13, connecting end 8 of flat flexible circuit 7 is adapted for connection with electrical connector 1 by means of actuator 6. A plurality (four) of conductors 23 are exposed on one side 8*a* of circuit 7 at connecting end 8 thereof. The conductors are generally parallel and on the same spacing or pitch as terminals 3. A generally rigid reinforcing plate 24 is adhered to an opposite side 8*b* of circuit: 7 at connecting end 8 thereof. The reinforcing plate defines a shoulder 24*a* extending in the width direction of the circuit. As best seen in FIG. 1, engaging portion 22 of actuator 6 has a height substantially the same as the thickness of reinforcing plate 24. In other words, engaging shoulder 22*a* of the actuator is coincident with shoulder 24*a* of reinforcing plate 24. The mutually engaging shoulders are of substantially the same width transversely of the circuit and should be at least as wide as the area covered by conductors 23 in the width direction of the circuit.

In terminating flat flexible circuit 7 to electrical connector 1, actuator 6 is removed from insulative housing 4 to open rear end 5 of the housing. Connecting end 8 of the circuit then is inserted between contact arms 17 and biasing arms 18 of terminals 3, with conductors 23 on side 8*a* at connecting end 8 of the circuit facing downwardly for engaging contact portions 17*a* (FIG. 1) of contact arms 17. Retaining plate 19 of actuator 6 then is inserted into the open rear end of the housing and into the spacing between the contact arms and the biasing arms of the terminals. When the actuator is fully inserted, locking projections 21 of the actuator interengage within openings 16 of the housing, thereby holding or locking the actuator in its inserted condition.

Although flat flexible circuit 7 was inserted into connector housing 4 with zero insertion forces, in the event that the circuit is not at its fully inserted position shown in FIG. 1, shoulder 22*a* of engaging portion 22 of the actuator will engage shoulder 24*a* of reinforcement plate 24 on the top of the circuit and bias the circuit to its final, completely inserted position. In the fully inserted condition of actuator 6, retaining plate 19 of the actuator receives the reaction forces from biasing arms 18 of terminals 3 to, thereby, press conductors 23 of circuit 7 firmly into engagement with contact portions 17*a* of contact arms 17 of the terminals. Reinforcement plate 24, being generally rigid, not only provides a means for effecting full insertion of the circuit into the housing by means of the actuator, but the rigid reinforcing plate is effective to provide a uniform pressure between conductors 23 of the circuit and contact portions 17*a* of the terminals in the width direction of the circuit and connector. The circuit cannot be unintentionally withdrawn from the connector because of the interengagement between shoulders 22*a* and 24*a*.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector for terminating a flat flexible circuit of a given width having conductors extending longitudinally thereof, the circuit having a reinforcing plate defining a shoulder extending in the width direction of the circuit substantially across the entire width of the flat flexible circuit, comprising:

an insulative housing having a plurality of terminals; and an actuator with a leading end and a rear end adapted to be inserted leading end first into the housing and to force the conductors of the flat flexible circuit into contact with the terminals, the actuator having an engaging portion adjacent the rear end extending in the width direction of the circuit substantially across the entire width of the flat flexible circuit for engaging said entire shoulder of the reinforcing plate and forcing the circuit into the housing.

2. The electrical connector of claim 1 wherein the conductors of the circuit are exposed on one side thereof and said reinforcing plate is disposed on the opposite side of the circuit.

3. The electrical connector of claim 1 wherein said reinforcing plate is generally rigid.

4. The electrical connector of claim 1 wherein said terminals each include a generally U-shaped end defining a biasing arm spaced from a contact arm such that the actuator is inserted into the space between the arms, with the contact arm engaging a conductor of the flat flexible circuit.

* * * * *